United States Patent [19]

Seidel

[11] Patent Number: 5,069,276

[45] Date of Patent: Dec. 3, 1991

[54] HEAT EXCHANGER ASSEMBLY AND PANEL THEREFOR

[75] Inventor: Pessach Seidel, Jerusalem, Israel

[73] Assignee: Oran Heating Equipment Limited, Jerusalem, Israel

[21] Appl. No.: 644,264

[22] Filed: Jan. 22, 1991

[30] Foreign Application Priority Data

Feb. 8, 1990 [IT] Italy ..... 93319

[51] Int. Cl.[5] ..... F28F 3/08

[52] U.S. Cl. ..... 165/166; 165/167

[58] Field of Search ..... 165/166, 167

[56] References Cited

U.S. PATENT DOCUMENTS

| | | | |
|---|---|---|---|
| 2,321,110 | 6/1943 | Shipman | 165/166 X |
| 3,216,495 | 11/1965 | Johnson | 165/166 |
| 3,862,661 | 1/1975 | Kovalenko et al. | 165/166 |
| 4,176,713 | 12/1979 | Fisher | 165/166 |
| 4,569,391 | 2/1986 | Hulswitt et al. | 165/166 |
| 4,872,578 | 10/1989 | Fuerschbach et al. | 165/167 |

FOREIGN PATENT DOCUMENTS

| | | | |
|---|---|---|---|
| 588426 | 12/1959 | Canada | 165/166 |
| 653296 | 12/1962 | Canada | 165/166 |
| 56-151898 | 11/1981 | Japan | 165/166 |
| 520610 | 4/1940 | United Kingdom | 165/166 |

*Primary Examiner*—Allen J. Flanigan

*Attorney, Agent, or Firm*—McAulay Fisher Nissen Goldberg & Kiel

[57] ABSTRACT

A parallel-flow heat exchanger composed of a plurality of stacked, substantially flat panels defining between them, in the stacked state, spaces through which are adapted to flow the media intended to exchange heat. In the panels there are provided inlet and outlet openings for each of the media. In the stacked state, the space between the nth and the (nth+1) of the panels is traversed by one of the media, while the space between the (nth+1) and the (nth+2) panel is traversed by the other one of the media. The inlet and outlet openings are located outside of the confines of the major surfaces of the panels and the axes of the openings lie in planes substantially parallel to the general plane of the panels.

18 Claims, 10 Drawing Sheets

HEAT EXCHANGER ASSEMBLY AND PANEL THEREFOR

BACKGROUND OF THE INVENTION

1. Field of the Invention

The present invention relates to a heat exchanger, more particularly to a brazed-plate, parallel-flow heat exchanger of more efficient structure. It also relates to a panel of which such a heat exchanger is assembled.

2. Description of the Prior Art

Brazed-plate heat exchangers, whether co-current or counter-current are well known and, because of their relative compactness, are used whenever high efficiency and modest space requirements are essential.

These known heat exchangers suffer, however, from a serious drawback: About 30% of the plate area is taken up by the inlet and outlet arrangements of the two heat-exchanging media. This constitutes a considerable waste of the expensive stainless-steel material of which most of today's heat exchangers are made.

SUMMARY OF THE INVENTION

It is one of the objects of the present invention to remedy the drawback of the prior-art brazed-plate heat exchangers and to provide a heat exchanger, the effective surface of the plates or panels of which is, for all practical purposes, equal to their geometrical surface.

According to the invention, this is achieved by providing a parallel-flow heat exchanger comprised of a plurality of stacked, substantially flat panels defining between them, in the stacked state, spaces through which are adapted to flow the media intended to exchange heat, further comprising, in said panels, inlet and outlet openings for each of said media, wherein in said stacked state the space between the nth and the (nth +1) of said panels is traversed by one of said media, while the space between said (nth +1) and the (nth +2) panel is traversed by the other one of said media, characterized in that said inlet and outlet openings are located outside of the confines of the major surfaces of said panels, the axes of said openings lying in planes substantially parallel to the general plane of said panels.

The invention further provides a panel for a multipanel heat exchanger made of a relatively thin, thermally conductive material, comprising a major surface provided with an embossed pattern giving a dimension of depth to said relatively thin panel material, and a peripheral skirt comprising inlet and outlet openings for each of the heat-exchanging media, characterized in that said inlet and outlet openings are located outside of the confines of said major surface of the panel, the axes of said openings lying in planes substantially parallel to the general plane of said panel.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DESCRIPTION OF THE PREFERRED EMBODIMENT

Figure 1:
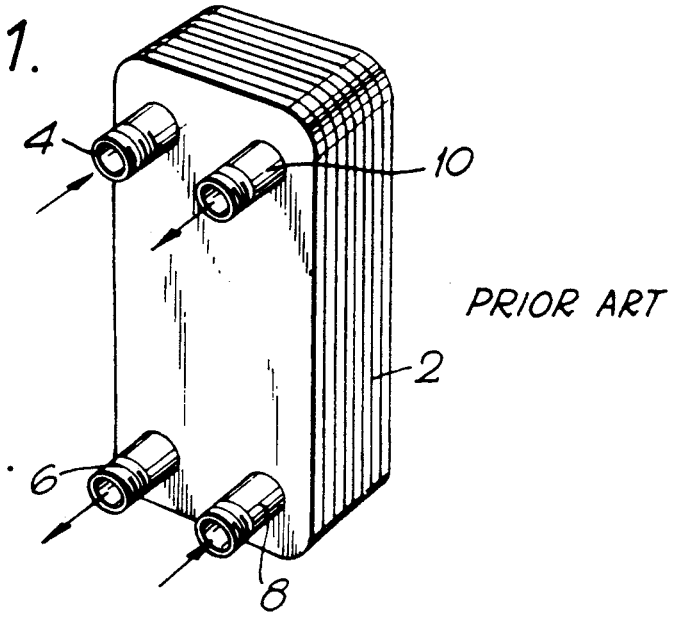
FIG. 1 is a perspective view of a prior art brazed-plate heat exchanger.

Referring now to the drawings, there is seen in FIG. 1 a prior-art heat exchanger comprising a plurality of plates or panels 2 which are brazed together and through alternate spaces formed between which panels flow the two heat-exchanging liquids. Further seen are an inlet connector 4 and an outlet connector 6 for the first of the two liquids, and an inlet connector 8 and an outlet connector 10 for the second liquid. It is immediately seen that a very considerable proportion (in fact, depending on the total length of the packet of panels, between 25 to 35%) does not participate to any degree of efficiency in the heat-exchanging process, consisting as it does of stagnant zones in which heat exchange is minimal. These zones are, of course, the areas, multiplied by the number of panels 2, between the connectors 4, 10 and the upper packet edge on the one side, and the connectors 6, 8 and the lower packet edge on the other.

Figure 2:
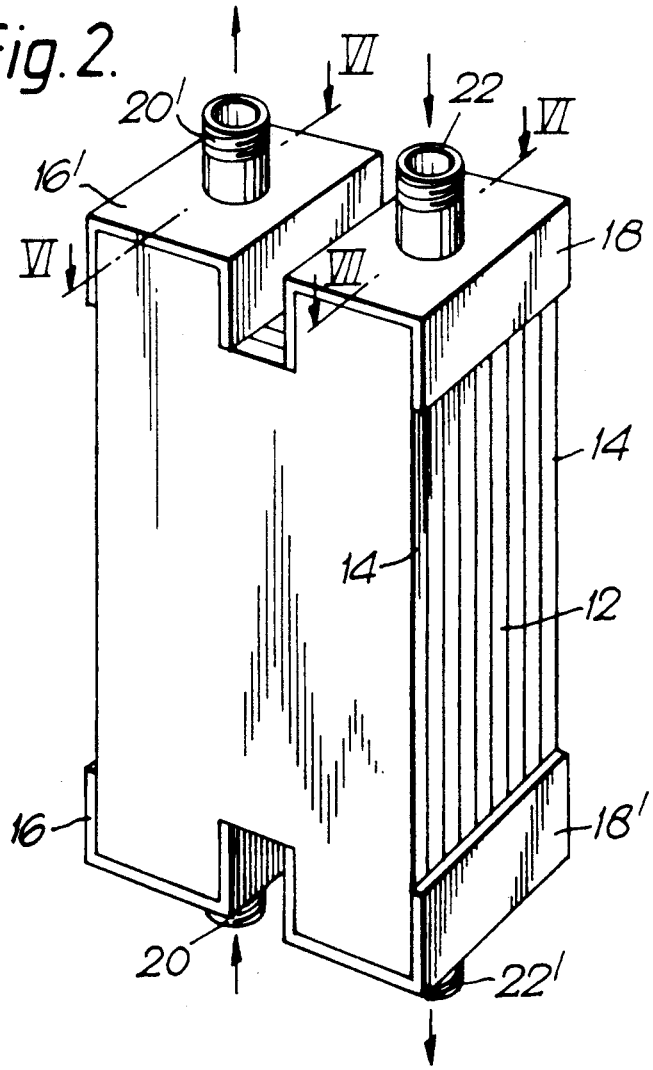
FIG. 2 is a perspective view of a preferred embodiment of the heat exchanger according to the invention.

The heat exchanger according to the invention, a parallel-flow heat exchanger, is represented in FIG. 2. There is seen a stack of embossed basic panels 12, the detailed shape of which will be discussed further below and which are brazed to one another to form a rigid structure. It is between adjacent panels in this stack that the heat-exchanging media flow, in thermal, but not physical, contact with one another.

The stack of panels 12 is protected on both the front and the rear by cover plates 14. Further seen are four manifold elements 16, 16',18,18', each with its pipe connector 20,20',22,22', respectively. Connectors 20,20' constitute the inlet and outlet connectors, respectively, for the first of the heat-exchanging media, and the connectors 22,22', serve the analogue purpose for the second medium. As indicated by the arrows, this heat exchanger works in the countercurrent mode. In the following, non-primed numerals will designate inlet components (openings, portals, connectors), while primed numerals will refer to outlet components.

The above notwithstanding, each of the media can naturally also flow in the opposite direction, in which case connector 20 would be the outlet connector, with connector 20' the inlet connector. Clearly, in order to preserve countercurrent heat exchange, the connectors 22, 22' of the other medium would also have to change their function.

In this embodiment, as is seen in FIG. 2, the manifold elements 16,16', 18,18' consist of sections of a U-shaped profile and are complemented by end portions of the cover plates 14.

Figure 3:
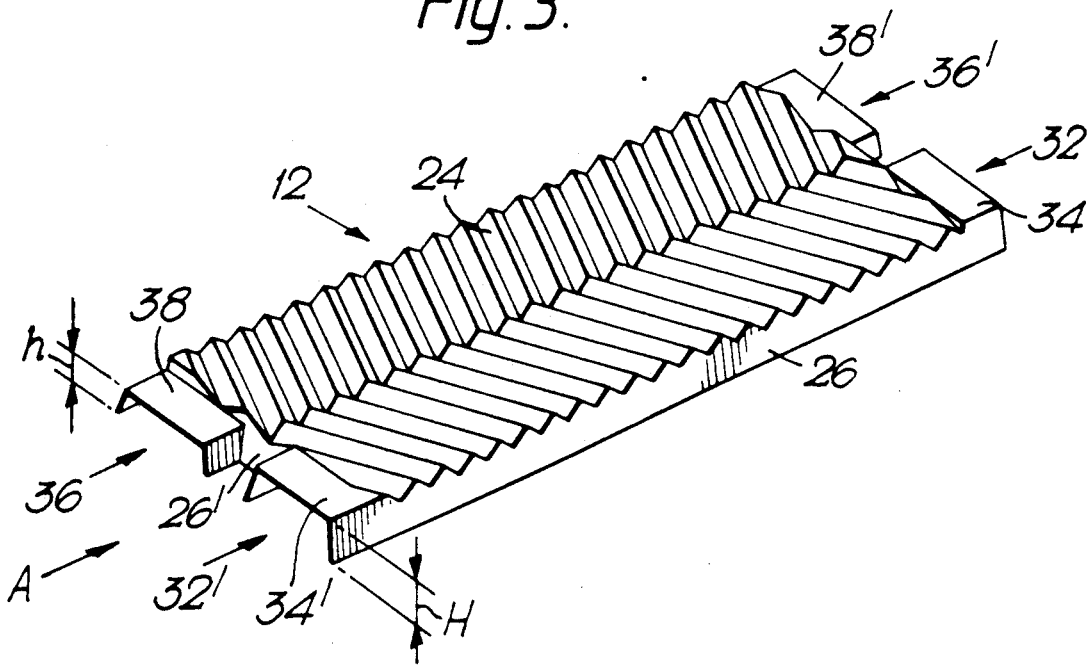
FIG. 3 represents a perspective view of a single panel of the heat exchanger of FIG. 2.
Figure 4:
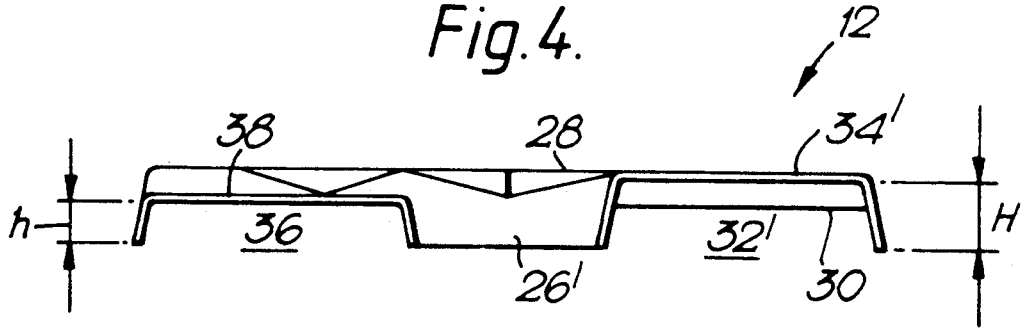
FIG. 4 is an enlarged side view of the panel of FIG. 3 as seen in direction of arrow A.

The individual panel 12 is depicted in FIGS. 3 and 4. The substantially rectangular panel, advantageously made of stainless steel sheet of a thickness of about 0.3 mm, is seen to have the shape of a shallow tray embossed with a pattern of corrugations 24 (which, for the sake of clarity, is shown with sharp crests and bottoms that, in reality, are preferably smoothly rounded). In this embodiment, the pattern is of the so-called herringbone type. However, as will be shown further below, other configurations, too, are possible.

The longitudinal edges of the panel 12 are provided with skirts 26. Seen in FIG. 4 is the common plane 28 containing the upper-side crests of the corrugations 24, and the common plane 30 containing the underside crests of the corrugations.

On each of the narrow sides of the panel 12 there are provided portal-like openings in the skirt 26', the opening 32' having a high portal 34' of a clear height H, and the opening 36 having a low portal 38 of a clear height h. While in this embodiment the roof of the high portal 34' is co-planar with the plane 28 (FIG. 3) and the ceiling of the low portal is co-planar with the plane 30, the roof of the high portal 34' could also slightly project above, or be sunk below, plane 28, as long as the difference in height between the two portals remains the same.

Between the portals 34'38 there is seen a short section 26' of the skirt 26.

FIGS. 3 and 4 clearly demonstrate the difference between the heat exchanger according to the invention, and the prior-art heat exchanger of FIG. 1: While in the latter the inlet and outlet arrangements take up a considerable proportion of the panel area, thereby greatly reducing the effective heat-exchanging area, in the heat exchanger according to the invention, this area is practically identical with the entire major surface area of the panel. Also, the axes of the inlet and outlet openings lie in planes parallel to the general plane of the panels.

Figure 5:
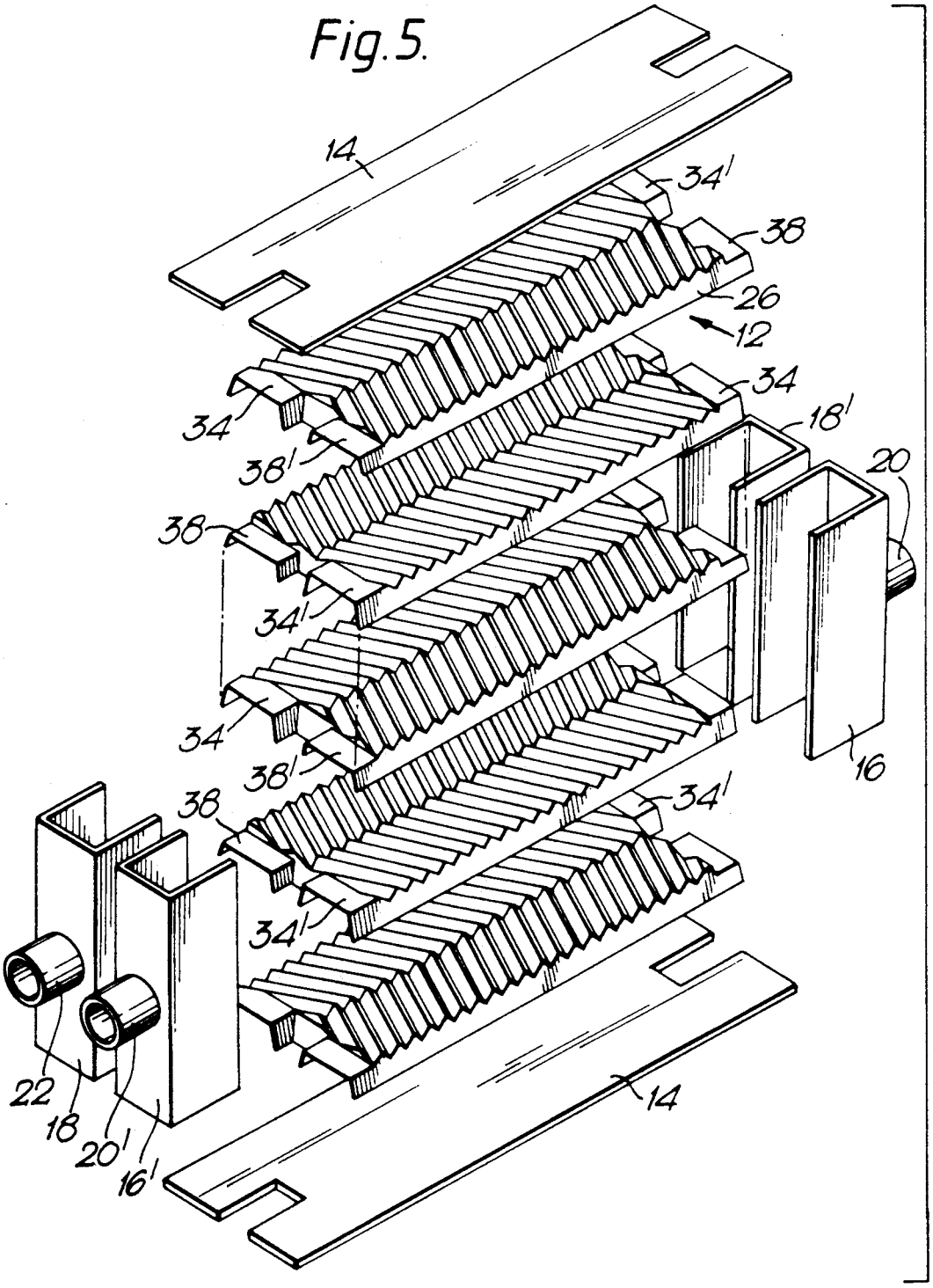
FIG. 5 is an exploded view of the heat exchanger of FIG. 2.

FIG. 5 is an exploded view of the heat exchanger of FIG. 2. It will be noticed that in every other panel 12 the herringbone pattern is reversed, so that the upper- and underside crests of the corrugations will intersect one another on adjacent panels, forming a lattice of contact points. Being subsequently brazed to one another, these points greatly increase the pressure resistance of the finished heat exchanger.

Figure 6:
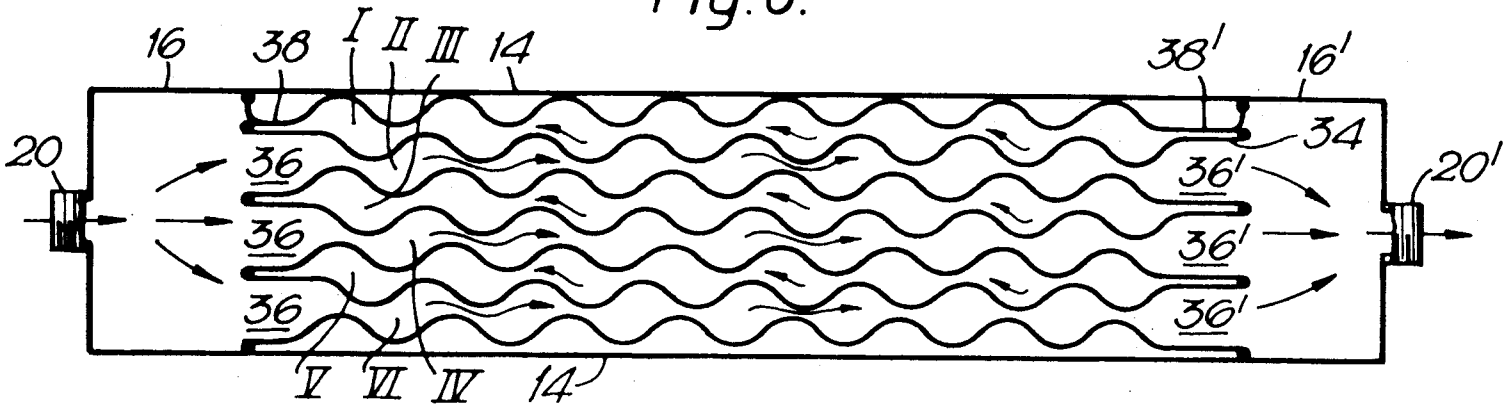
FIG. 6 is a schematic cross-sectional view along plane VI—VI of FIG. 2.

FIG. 6 is a schematic cross-sectional view, along plane VI—VI in FIG. 2, of the heat exchanger according to the invention. The first medium is introduced into the manifold 16 through the inlet connector 20 and, through the inlet openings 36, enters the flow spaces II, IV and VI, formed between the 2nd and 3rd, 4th and 5th, 6th and 7th panel respectively, and, entering the manifold 16' via the outlet openings 36', leaves the heat exchanger through the outlet connector 20'.

Figure 7:
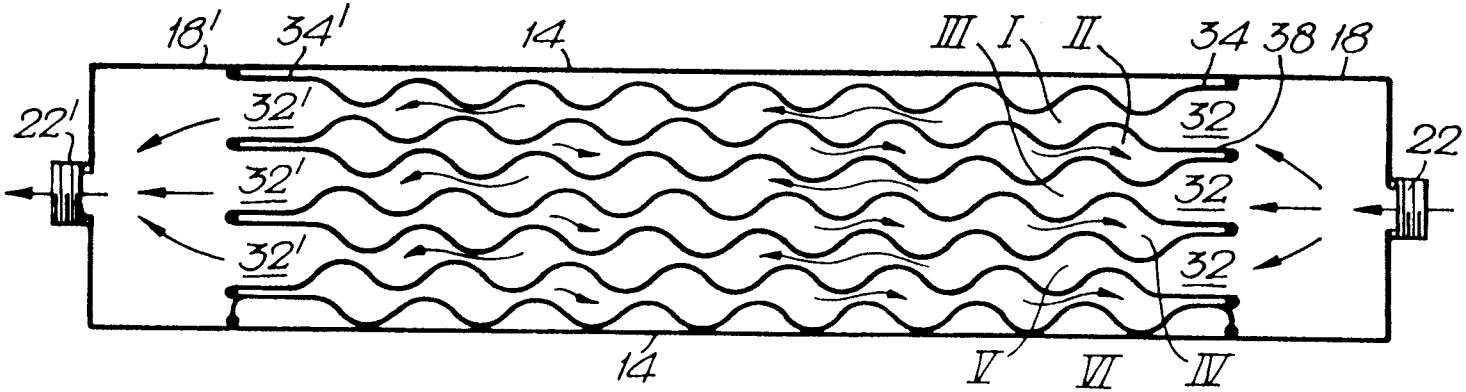
FIG. 7 is a similar view along plane VII—VII of FIG. 2.

FIG. 7 is a similar cross-sectional view, but along plane VII—VII of FIG. 2. Here, the second medium is introduced into the manifold 18 through the inlet connector 22 and, through the inlet openings 32, enters the flow spaces I, III, and V, formed between the 1st and 2nd, 3rd and 4th, 5th and 6th panel respectively. Entering the manifold 18' via the outlet openings 32', the second medium leaves the heat exchanger through the outlet connector 22'.

The space between the cover plates 14 and their adjacent panels (1st and 7th) is not utilized and is carefully sealed off with respect to the manifolds.

It will be appreciated that in order to prevent direct contact between the two heat-exchanging media, the flow spaces II, IV and VI must be reliably sealed off not only towards the outside, along the skirts 26, but also from the flow spaces I, III and V. This is also done by brazing.

To facilitate full nesting of adjacent panels 12 both along the skirts 26 and around the portals 34,38, as well as the already mentioned proper point contact between the corrugations of adjacent panels, certain dimensional relationships are required, which will be explained with the aid of FIG. 8, which illustrates a stack of five properly-nested panels 12.

Setting out from the given magnitudes: D, H, B and W, where

D = depth of corrugations,

H = depth of skirt,

B = thickness of panel material, and

W = (sharp) inside corner-to-inside corner width of the low portal 38, the variables h, $\alpha$, and w, where h = clear height of the low portal 38, $\alpha$ = slope of skirt and portal sides, and w = inside corner-to-inside corner width of high portal 34, are obtained by the expressions:

$$h = H - D$$

$$\alpha = \arcsin B/(D+B)$$

$$w = W - 2Btg(45 - \alpha/2).$$

Figure 8:
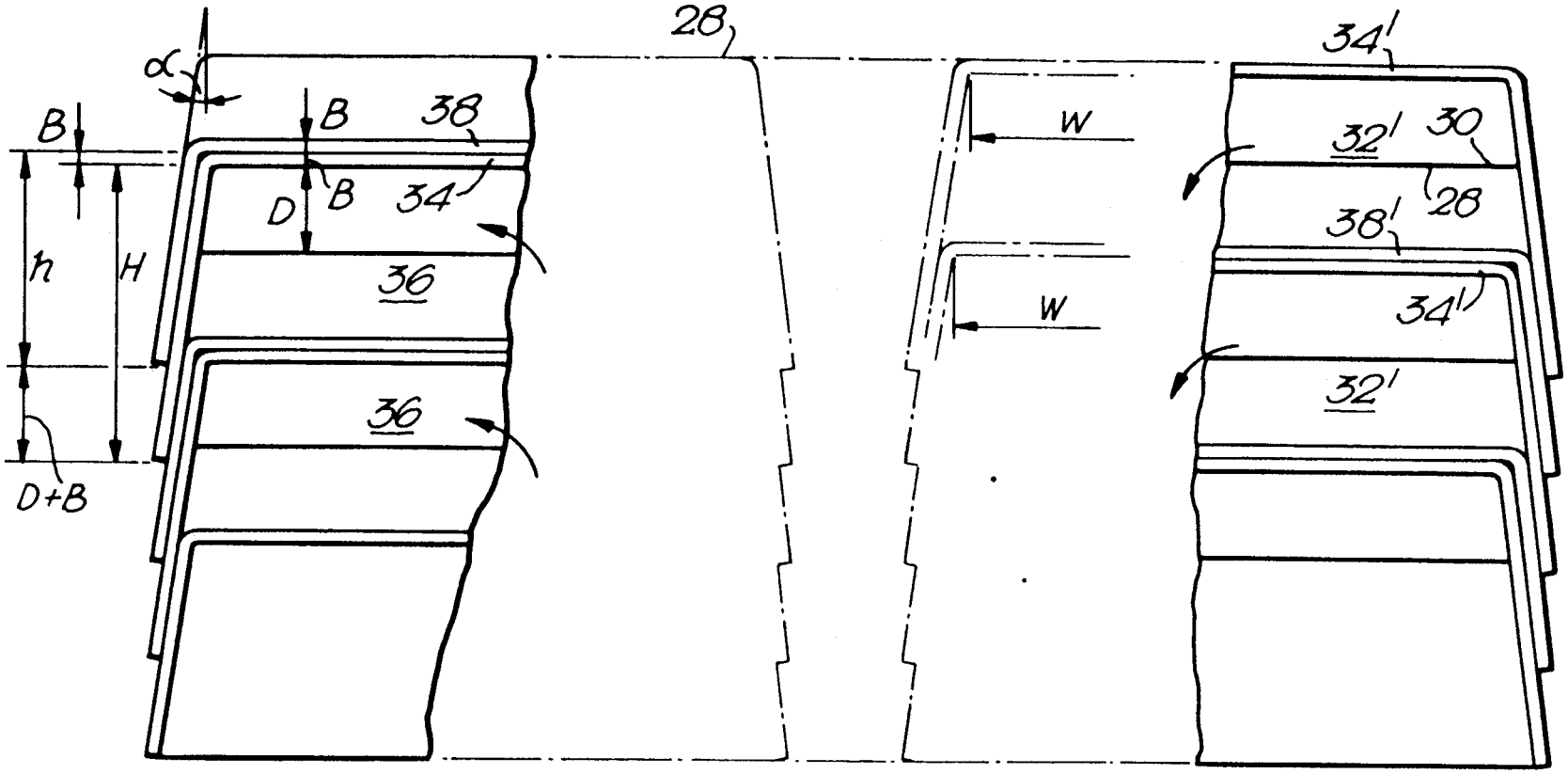
FIG. 8 is a greatly enlarged side view of a stack of nested panels.

The panel 12 of FIG. 3 has the advantage that, upon turning by 180° for stacking and nesting (in order, as already mentioned, to reverse the herringbone pattern of every other panel), the portals 38 and 34 will be brought to their proper nesting order (low portals 38 always being paired off with high portals 34—see FIGS. 5 and 8). This means that a single panel configuration (produced by a single set of stamping and drawing tools) can be used to assemble an entire stack. This arrangement, while cutting tooling costs, has, however, a definite disadvantage: As the inlet and outlet openings of a given medium (e.g., 36, 36') are always opposite each other close to one of the panel sides, while the interpanel flow space (e.g., II, IV, VI) extends over the whole width of the panel 12, flow conditions in that half of the flow spaces that contain the inlet and outlet openings 36, 36' are likely to be more conducive to heat exchange than flow conditions in the other half. This is liable to reduce overall heat-exchange efficiency of the device.

Figure 9:
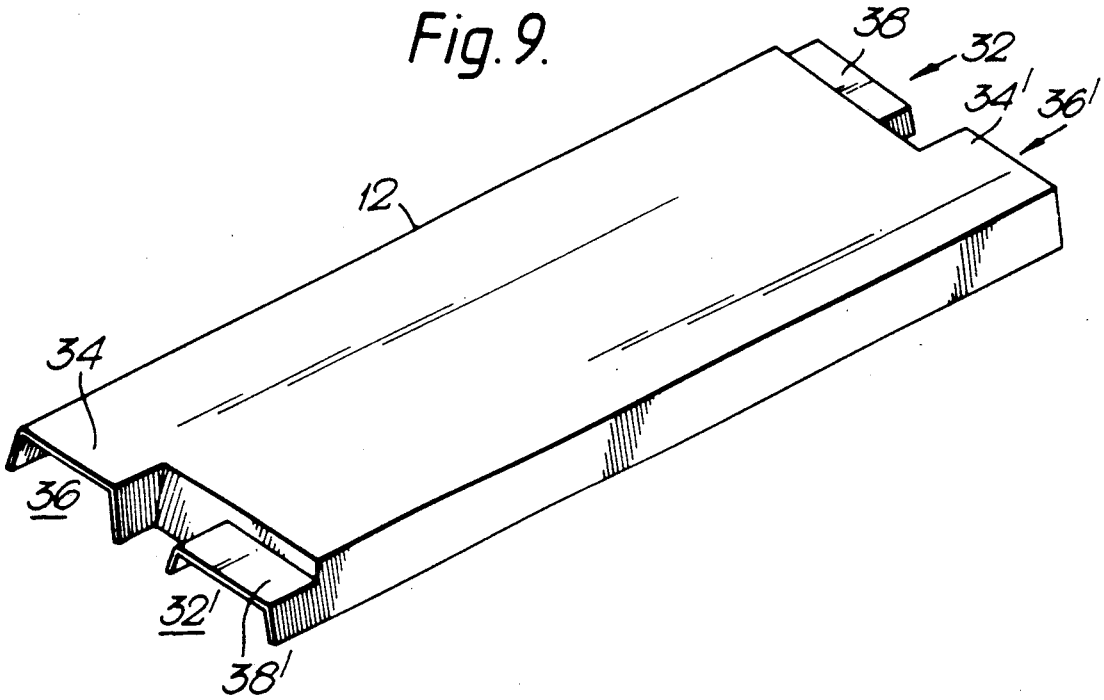
FIGS. 9 and 10 are schematic perspective views of "left-" and "right-handed" panels according to the invention.
Figure 10:
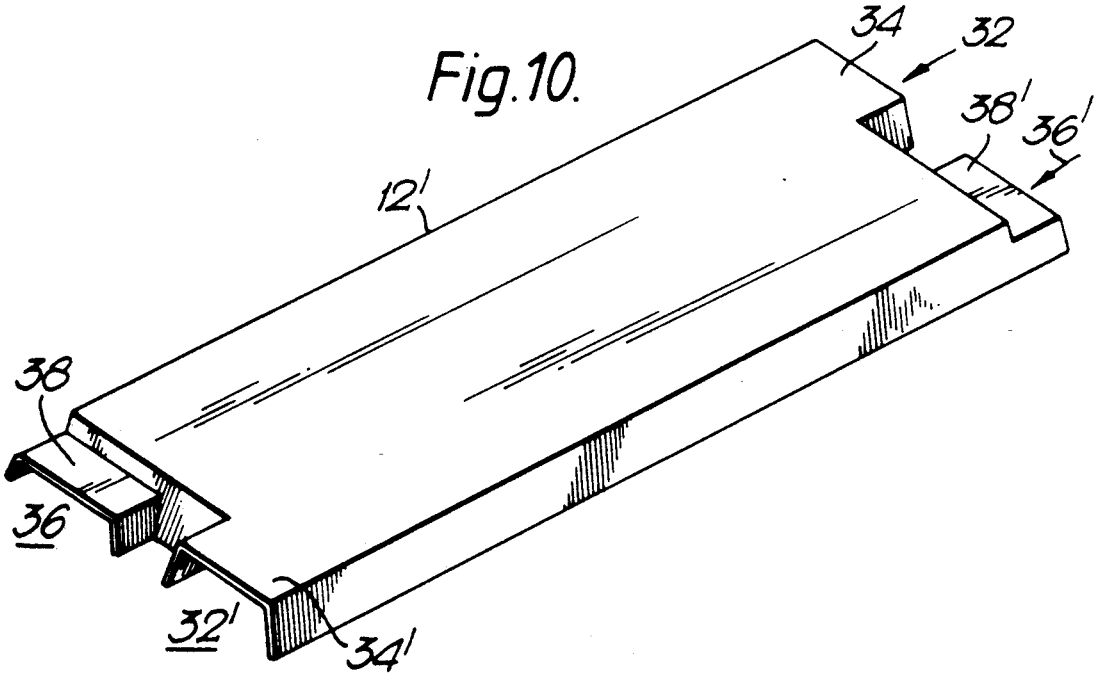

The pair of adjacent panels 12, 12' schematically represented in FIGS. 9 and 10, need not, in fact cannot, be reversed, as they are not identical, being "left-" and "right-" handed, respectively. As a consequence, the inlet and outlet openings of one and the same medium are always diagonally opposite, which renders flow conditions across the entire flow space much more uniform. While this design largely remedies the above-mentioned disadvantage, this arrangement obviously requires two sets of stamping and drawing tools.

Figure 11:
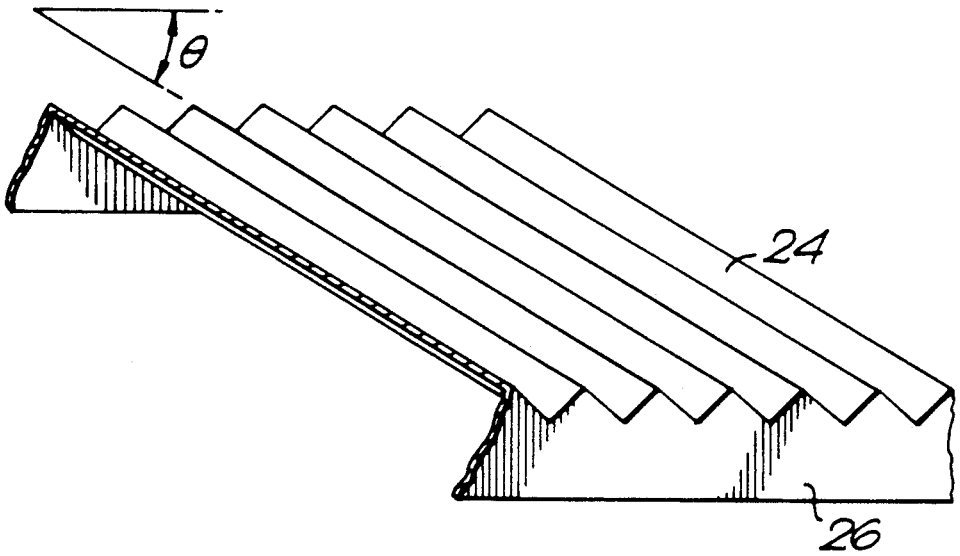
FIG. 11 is a partial perspective view of a rectilinear, slanted corrugation.

The herringbone pattern shown so far is not the only possible configuration of the heat-exchanging panel surface. FIG. 11, for instance, shows a rectilinear corrugation pattern that includes with the longitudinal axis of the panel an angle $\theta$. The advantage of this pattern resides in the fact that, by varying the angle $\theta$, the so-called thermal length of the device can be varied, to achieve a required $\Delta t$. A corrugating die is envisaged that will enable panel blanks to be embossed at any desired angle $\theta$.

The reinforcing and turbulence-causing effect of the corrugations can also be achieved by other means such as, e.g., a plurality of projections in the form of low cone frustums raised from the material of the panel and so distributed over the panel surface as to interfere with straight flow and to produce turbulences that enhance heat exchange.

Figure 12:
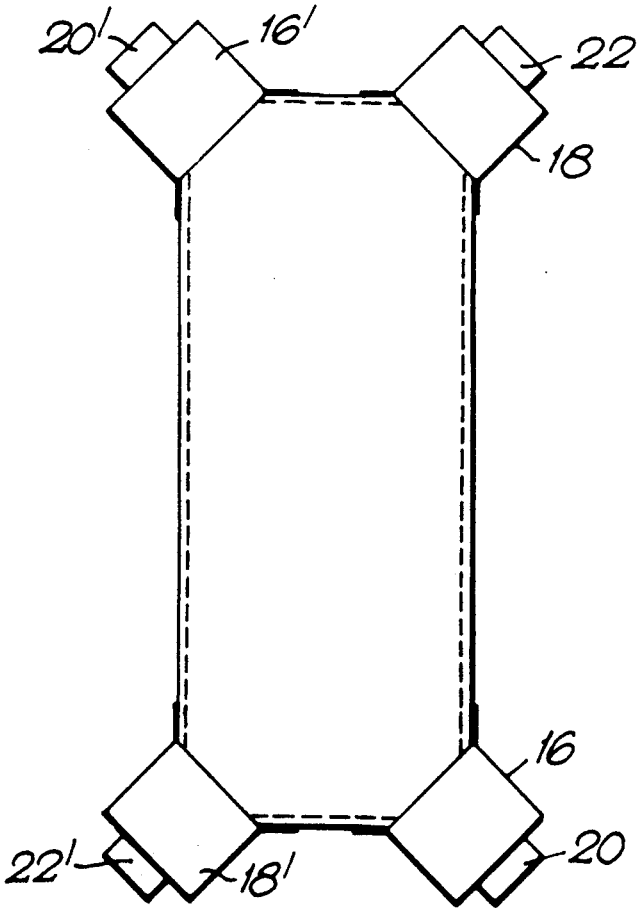
FIGS. 12 and 13 are plan views of heat exchangers having manifolds at different locations.
Figure 13:
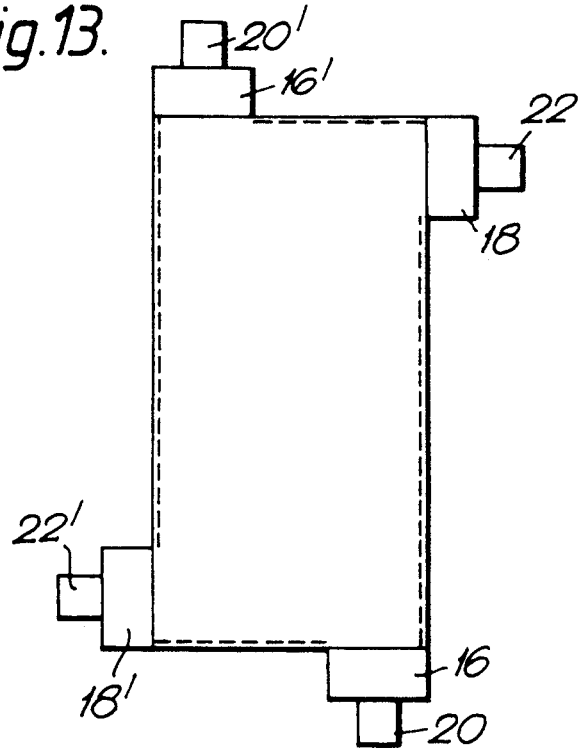

One of the great advantages of the present invention resides in the fact that the heat exchangers can be produced with the manifolds attached practically anywhere along the periphery of the stack of panels, as is best suited for a particular application. Thus in FIG. 12, the manifolds 16,16',18,18' are mounted at the corners of the stack of panels, while in the arrangement shown in FIG. 13 the axes of the connectors 20,20',22,22' include with each other angles of 90°.

Figure 14A:
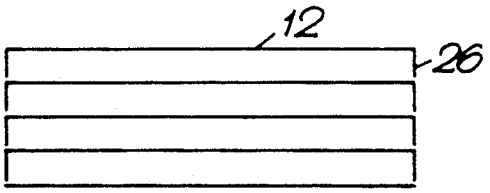
FIGS. 14*a*-14*c* illustrate different methods of joining panels in a stack.
Figure 14B:
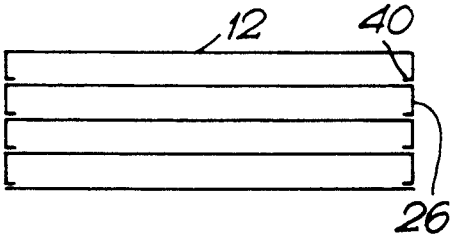
Figure 14C:
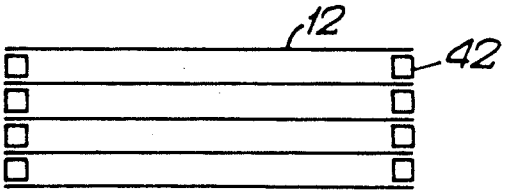

While the above-described stacking method involving nesting is indeed a preferred method, other stacking methods are equally within the scope of the present invention. Thus the skirts 26 of the panels 12 in FIG. 14*a* are simply butt-joined to the adjacent panel. In FIG. 14*b*, the skirts 26 are complemented by a flange 40 which, by increasing the contact area, strengthens the joint. In the arrangement represented in FIG. 14*c*, the panels 12 have no skirts at all, there being provided frame-like structures 42 which both join and seal off the panels 12.

A better flow regime and, thus, higher heat-exchange efficiency can be obtained by making the panels wide enough to permit the provision, for each of the heat-exchanging media, of at least two inlet openings connected in parallel to a single inlet connector, as well as two similarly connected outlet openings.

Figure 15:
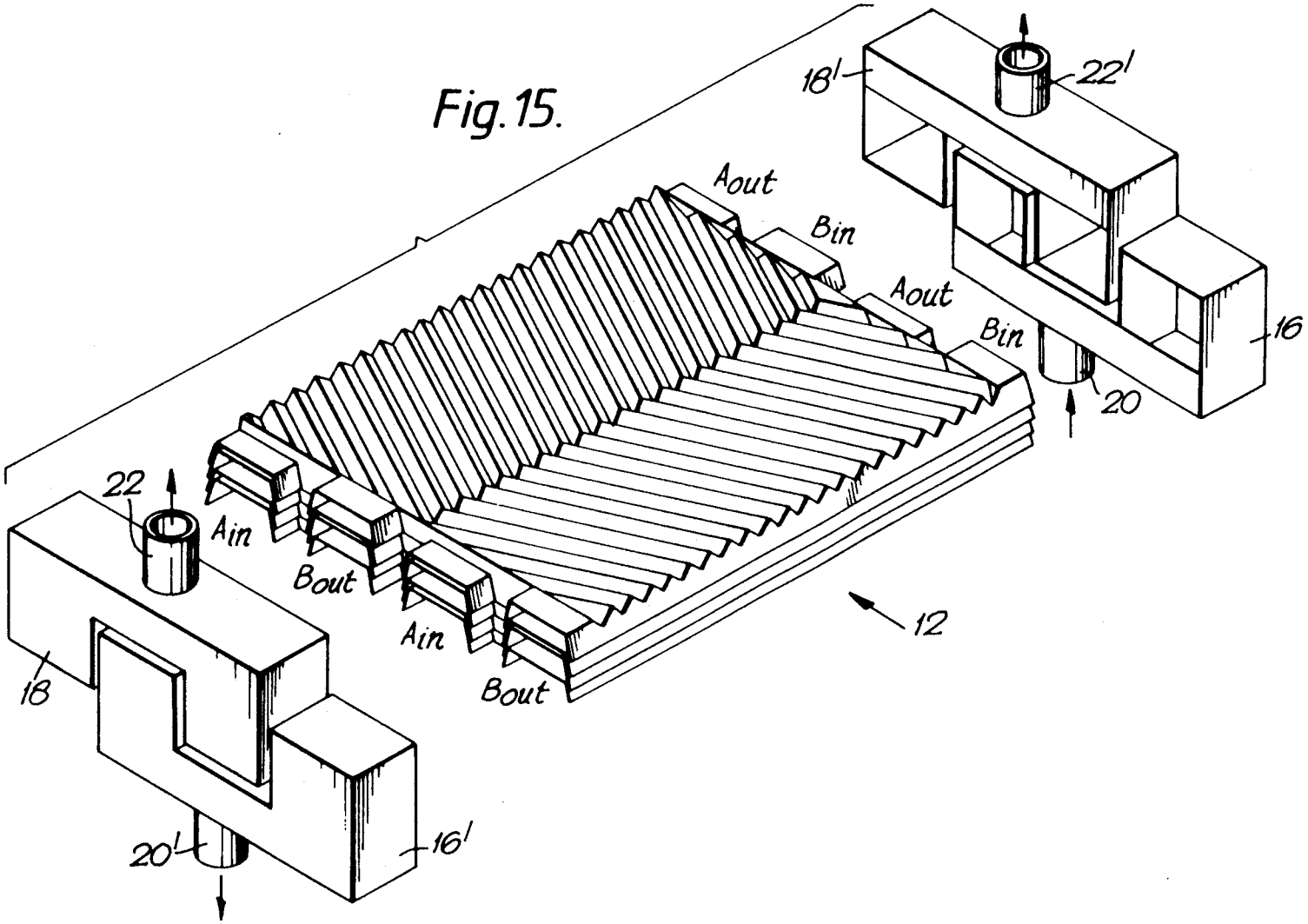
FIG. 15 is a partly exploded view of yet another embodiment of the heat exchanger according to the invention.

Such an embodiment is represented in FIG. 15. There is seen a partial stack of panels 12 of the type shown in FIGS. 3 and 5, except that each panel 12 is wide enough to accommodate two inlet and two outlet openings for the first medium, defined by the portal columns $A_{in}$ and $A_{out}$, respectively, and two inlet and two outlet openings for the second medium, defined by the portal column $B_{in}$ and $B_{out}$, respectively. Likewise, there is provided an inlet manifold 18 for the first medium, attached to the two columns $A_{in}$ and supplied by the inlet connector 22, an inlet manifold 16 for the second medium, attached to the two columns $B_{in}$ and supplied by the inlet connector 20 and, analogously, an outlet manifold 18' with outlet connector 22' for the first medium and an outlet manifold 16' with outlet connector 20' for the second medium, the outlet manifolds being attached to the respective columns $A_{out}$ and $B_{out}$.

Figure 16:
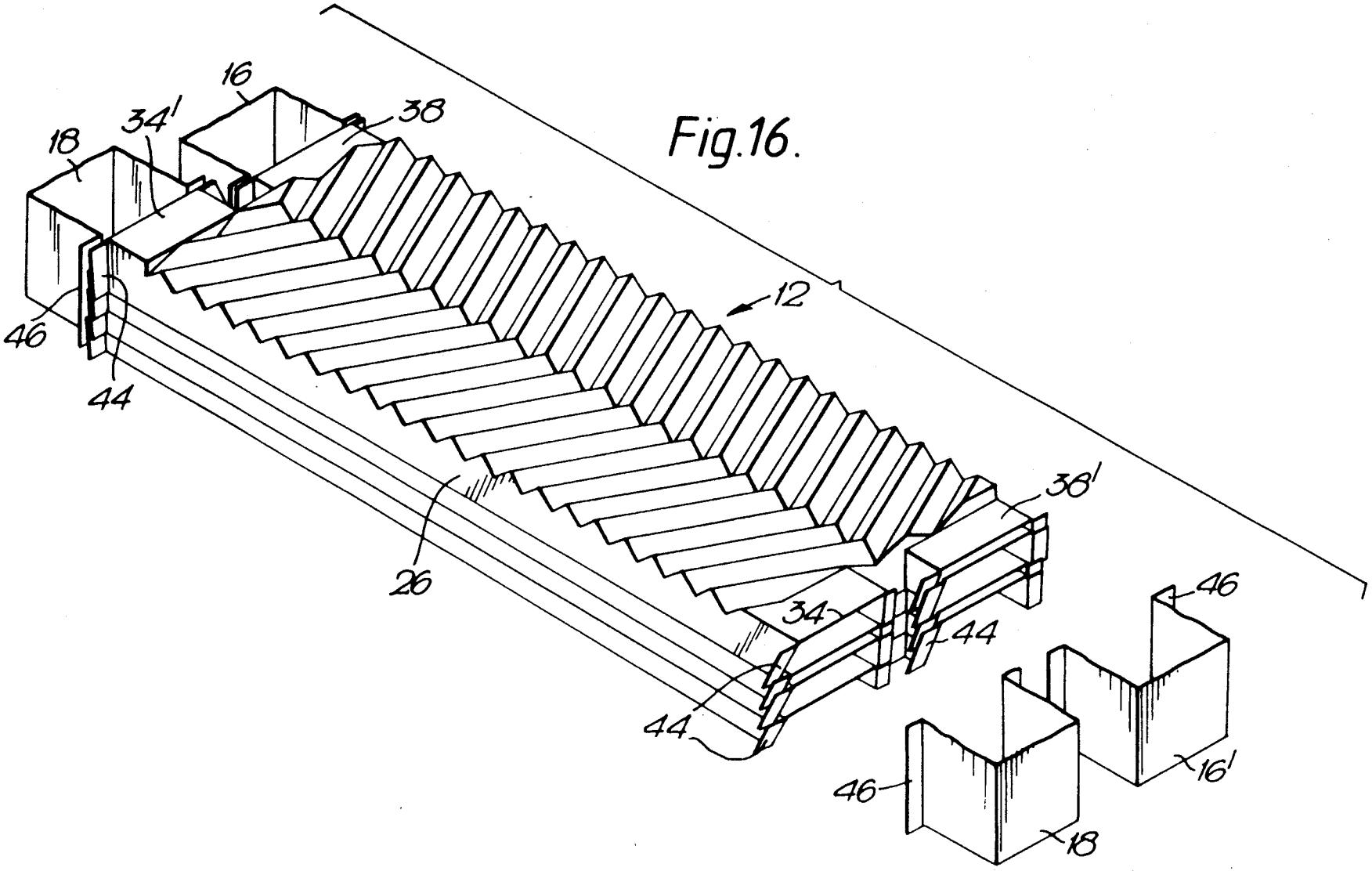
FIG. 16 represents variants of the heat exchanger components shown in FIGS. 3 to 5.

FIG. 16 illustrates variants of the heat exchanger components shown in FIGS. 3 to 5. In order to reduce the difficulty of providing a liquid-tight brazing joint between the portals 34,38',34',38 and their respective manifolds 18,16',18',16, it was found advantageous to provide the portals with laterally projecting flanges 44, which match appropriate counter-flanges 46 provided on the manifolds 16'18,16', 18'.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A parallel-flow heat exchanger comprised of a plurality of stacked, substantially flat panels defining between them, in the stacked state, spaces through which are adapted to flow the media intended to exchange heat, further comprising:

in said panels, inlet and outlet openings for each of said media, wherein in said stacked state the space between the nth and the (nth +1) of said panels is traversed by one of said media, while the space between said (nth +1) and the (nth +2) panel is traversed by the other one of said media, said inlet and outlet openings being located outside of the confines of said panels, the axes of said openings lying in planes substantially parallel to the general plane of said panels and the surfaces of said panels being embossed with a corrugated pattern, producing two different surface levels, an upper level containing the upper side crests of said corrugated pattern, and a lower level containing the underside crests of said corrugated pattern, said inlet and outlet openings being surrounded on at least three sides by a portal-like structure, and the upper portion of the portal-like structure of the inlet and outlet openings serving one of said media being substantially co-planar with said upper level, and the upper portion of the portal-like structure of the inlet and outlet openings serving the other one of said media being substantially co-planar with said lower level.

2. The heat exchanger as claimed in claim 1, wherein said panels are provided with peripheral skirts, whereby each of said panels is nestable within the skirt of an adjacent panel and wherein, when nested, the upper side crests of the nested panel substantially contact the underside crests of the nesting panel.

3. The heat exchanger as claimed in claim 1, wherein said skirt reaches below said lower level.

4. The heat exchanger as claimed in claim 2, wherein said inlet and outlet openings are provided in said skirts.

5. The heat exchanger as claimed in claim 1, further comprising at least four manifolds attached to said stacked panels, a first manifold interconnecting at least some inlet openings for said one medium, a second manifold interconnecting at least some outlet openings for said one medium, a third manifold interconnecting at least some inlet openings for said other medium, and a fourth manifold interconnecting at least some outlet openings for said other medium, each manifold having a connector for connection to an external medium carrier.

6. The heat exchanger as claimed in claim 1, wherein said corrugated pattern is of the herringbone type.

7. The heat exchanger as claimed in claim 1, wherein said corrugated pattern is rectilinear, but slanted relative to a major axis of said panel.

8. The heat exchanger as claimed in claim 6, wherein the herringbone pattern of the corrugations of one of said panels, when stacked, points in the opposite direction of that of the immediately adjacent panels.

9. The heat exchanger as claimed in claim 7, wherein the slanting corrugations of one of said panels, when stacked, cross the slanting corrugations of the immediately adjacent panels.

10. The heat exchanger as claimed in claim 1, wherein the inlet and outlet openings of one and the same medium are located opposite one another along a line parallel to the major axis of said panel.

11. The heat exchanger as claimed in claim 1, wherein the inlet and outlet openings of one and the same medium are located opposite one another along a line intersecting the major axis of said panel.

12. A panel for a multipanel heat exchanger made of a relatively thin, thermally conductive material, comprising:

a major surface provided with an embossed pattern giving a dimension of depth to said relatively thin panel material, and a peripheral skirt comprising inlet and outlet openings for each of the heat-exchanging media, said inlet and outlet openings being located outside of the confines of said major surfaces of the panel, the axes of said openings lying in planes substantially parallel to the general plane of said panel, said embossed pattern producing two different surface levels, an upper level containing the upper side high points of said embossed pattern, said inlet and outlet openings being surrounded on at least three sides by a portal-like structure, and said upper portion of the portal-like structure of the inlet and outlet openings serving one of said media being substantially co-planar with said upper level, and the upper portion of the portal-like structure of the inlet and outlet openings serving the other one of said media being substantially co-planar with said lower level.

13. The panel as claimed in claim 12, wherein said embossed pattern is of the herringbone type.

14. The panel as claimed in claim 12, wherein said embossed pattern is rectilinear, but slanted relative to a major axis of said panel.

15. The panel as claimed in claim 12, wherein the inlet and outlet openings of one and the same medium are located opposite one another along a line parallel to the major axis of said panel.

16. The panel as claimed in claim 12, wherein the inlet and outlet openings of one and the same medium are located opposite one another along a line intersecting the major axis of said panel.

17. The panel as claimed in claim 12, wherein said panel has at least two inlet openings and at least two outlet openings for each of the media.

18. The heat exchanger as claimed in claim 12, wherein upright members of said portal-like structures are provided with laterally projecting flanges.

* * * * *